US006933815B2

(12) United States Patent
Saruwatari et al.

(10) Patent No.: US 6,933,815 B2
(45) Date of Patent: Aug. 23, 2005

(54) ELECTROMAGNETIC RELAY

(75) Inventors: Yojiro Saruwatari, Kumamoto (JP); Keisuke Yano, Kumamoto-ken (JP); Shinichi Furusyo, Kumamoto (JP); Tetsuya Fujiwara, Kumamoto (JP); Ryota Minowa, Yamaga (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/829,673

(22) Filed: Apr. 22, 2004

(65) Prior Publication Data

US 2005/0007221 A1 Jan. 13, 2005

(30) Foreign Application Priority Data

Apr. 24, 2003 (JP) ..... P2003-120309

(51) Int. Cl.[7] ..... H01H 51/22; H01H 73/12
(52) U.S. Cl. ..... 335/78; 335/17
(58) Field of Search ..... 335/17, 78–86

(56) References Cited

U.S. PATENT DOCUMENTS 5,986,529 A * 11/1999 Miyata et al. ..... 335/78
6,498,552 B1 * 12/2002 Lozano Rico ..... 335/78

FOREIGN PATENT DOCUMENTS

WO WO 01/48777 A1 7/2001

* cited by examiner

*Primary Examiner*—Ramon M. Barrera
(74) *Attorney, Agent, or Firm*—Osha-Liang LLP

(57) ABSTRACT

An electromagnetic relay, which is excellent in assemblability and includes an indicator which can be operated smoothly, is provided. A coil block and a contact switching mechanism are provided on a base plate, a case is covered over the base plate, the coil block is excited and demagnetized to rotate a movable iron piece, and a movable contact piece is operated via a card, whereby a contact is opened and closed. Bearing portions are formed in the base plate, and an indicator is operated by rotation of the movable iron piece is also provide. The indicator has an elastically deformable structure including pivots which are rotatably supported by the bearing portions of the base plate.

14 Claims, 17 Drawing Sheets

ELECTROMAGNETIC RELAY

CROSS-REFERENCE TO RELATED APPLICATIONS

This application claims priority from Japanese Application JP2003-120309, filed on Apr. 24, 2003.

BACKGROUND OF THE INVENTION

1. Field of the Invention

The present invention relates to an electromagnetic relay.

2. Description of the Related Art

Conventionally, as an electromagnetic relay, there is one which is adapted to drive a movable piece with excitation and demagnetization of a coil block to operate an indicator (e.g., see WO01/48777 A1).

However, in the electromagnetic relay, since the indicator is pressed in and fixed to a base plate, the indicator may not be connected to the movable piece successfully depending upon a press-in position, and assemblability of the electromagnetic-relay is not satisfactory. In addition, since the indicator is bent for operation, an excessive force is required for driving the movable piece, and power consumption in the coil block increases.

SUMMARY OF THE INVENTION

Thus, it is an object of the invention to provide an electromagnetic relay which is excellent in assemblability and includes an indicator which can be operated smoothly.

The invention provides, as means for solving the above-mentioned problem, an electromagnetic relay which provides a coil block and a contact switching mechanism on a base plate to cover the base plate with a case and is adapted to excite and demagnetize the coil block to rotate a movable iron piece, and operate a movable contact piece via a card to thereby open and close a contact, wherein a bearing portion is formed on the base plate, an indicator to be operated by rotation of the movable iron piece is provided, and the indicator has an elastically deformable structure including a rotatably supported pivot in the bearing portion of the base plate.

With this structure, in attaching the indicator to the base plate, the pivot only has to be engaged with the bearing portion while being elastically deformed, and the electromagnetic relay is excellent in assemblability. Since the pivot is rotatably supported by the bearing portion, the indicator can be operated smoothly, and it is possible to reduce power consumption in the coil block.

It is preferable that the indicator includes a guide portion, which guides the indicator such that upward movement of the indicator is prevented by a guide receiving portion formed in the card, because it becomes possible to prevent an operation failure of the indicator surely.

It is preferable that the indicator has an indication piece at an upper end thereof and includes a guide portion between the indication piece and the pivot because a moving length of the indication piece can be amplified with respect to a moving length of the card, and it becomes possible to make confirmation of an operation easy.

It is preferable that the guide portion is constituted by a shaft portion and the guide receiving portion is formed in substantially a U shape for guiding the shaft portion from an upper part because it becomes possible to prevent an operation failure of the indicator with a simple structure.

It is preferable that the case includes a projected portion, which forms a space in which the indication piece of the indicator can operate, because it becomes possible to locate the indication portion of the indicator in a position excellent in visibility.

It is preferable that a cover is mounted on an upper surface of the case and a window, which makes the indication portion visible only when the coil block is excited and the indicator operates, is formed in the cover because it becomes possible to make confirmation of an operation easy.

BRIEF DESCRIPTION OF THE DRAWINGS

In the accompanying drawings:

FIG. 11C is a sectional view along line XC—XC in FIG. 10A;

DESCRIPTION OF THE PREFERRED EMBODIMENTS

Figure 1:
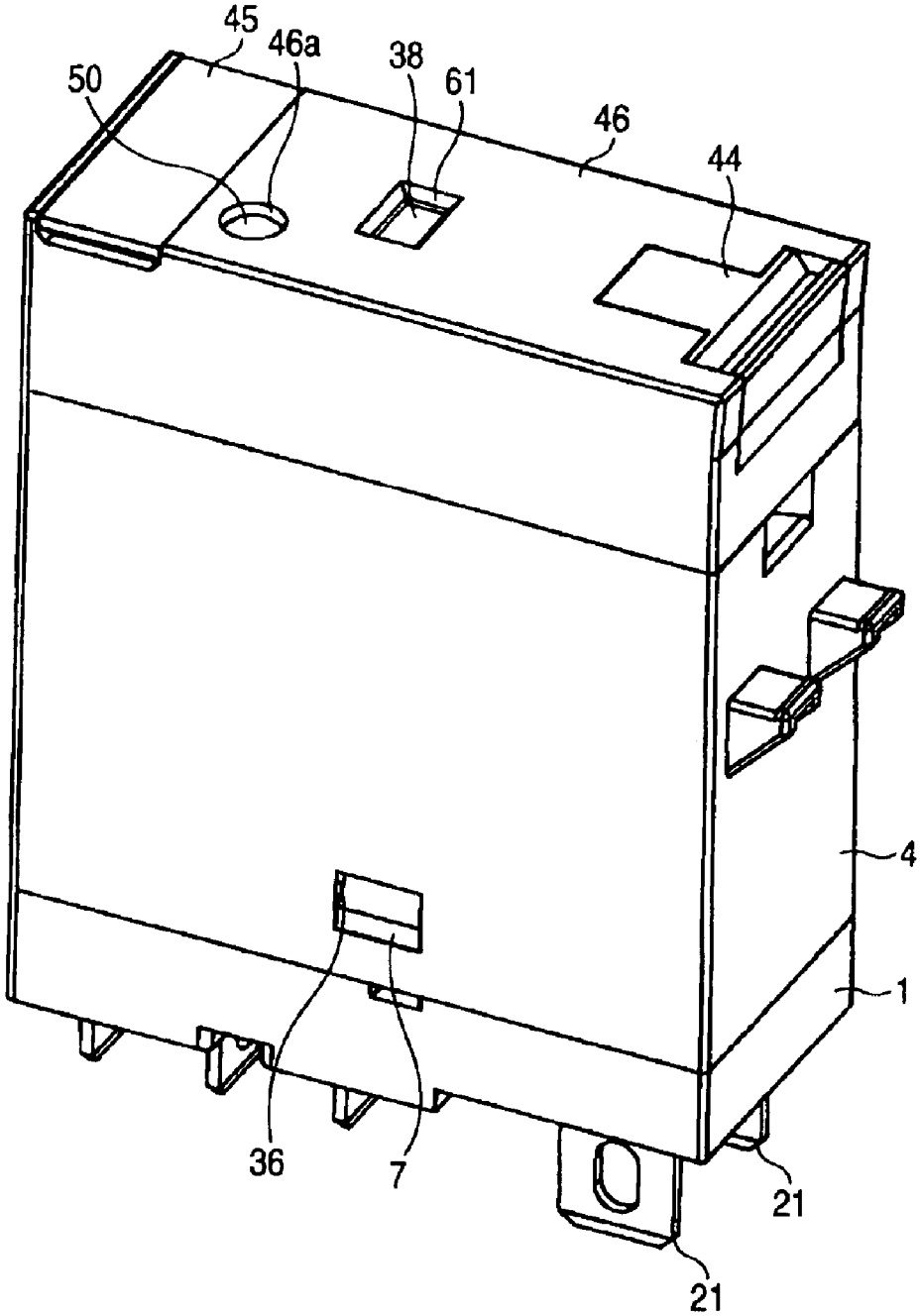
FIG. 1 is a perspective view of an electromagnetic relay in accordance with an embodiment of the invention.

Embodiments in accordance with the invention will be hereinafter described with reference to the accompanying drawings.

FIGS. 1 to 4 show an electromagnetic relay in accordance with an embodiment of the invention. This electromagnetic relay generally has a structure in which a coil block 2 and a contact switching mechanism 3 are provided on a base plate 1, a case 4 is covered over the base plate 1, and an indication block 5 is arranged on an upper surface of the case 4.

Figure 3:
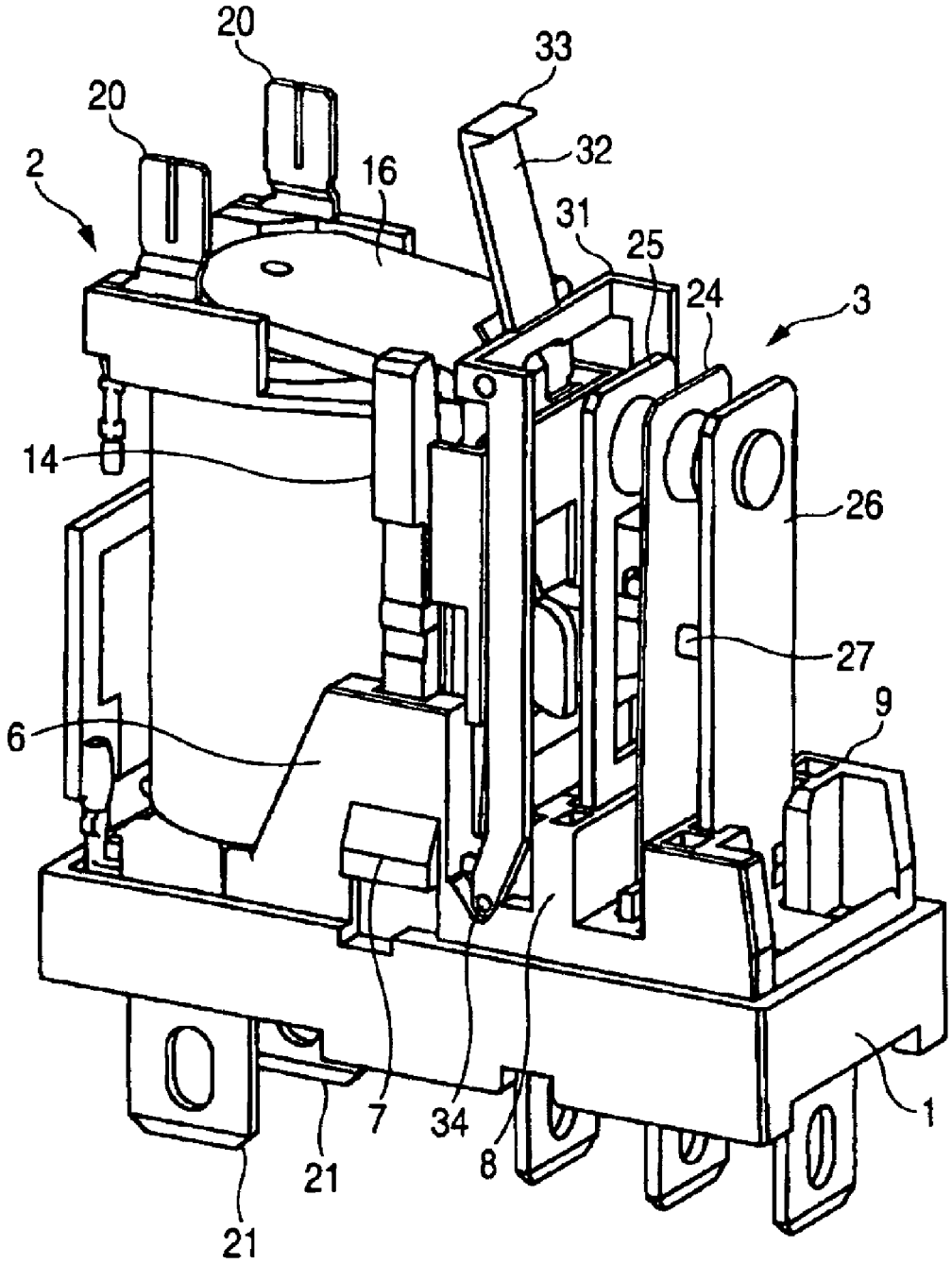
FIG. 3 is a perspective view showing a state in which a case is removed from a state of FIG. 2.
Figure 5:
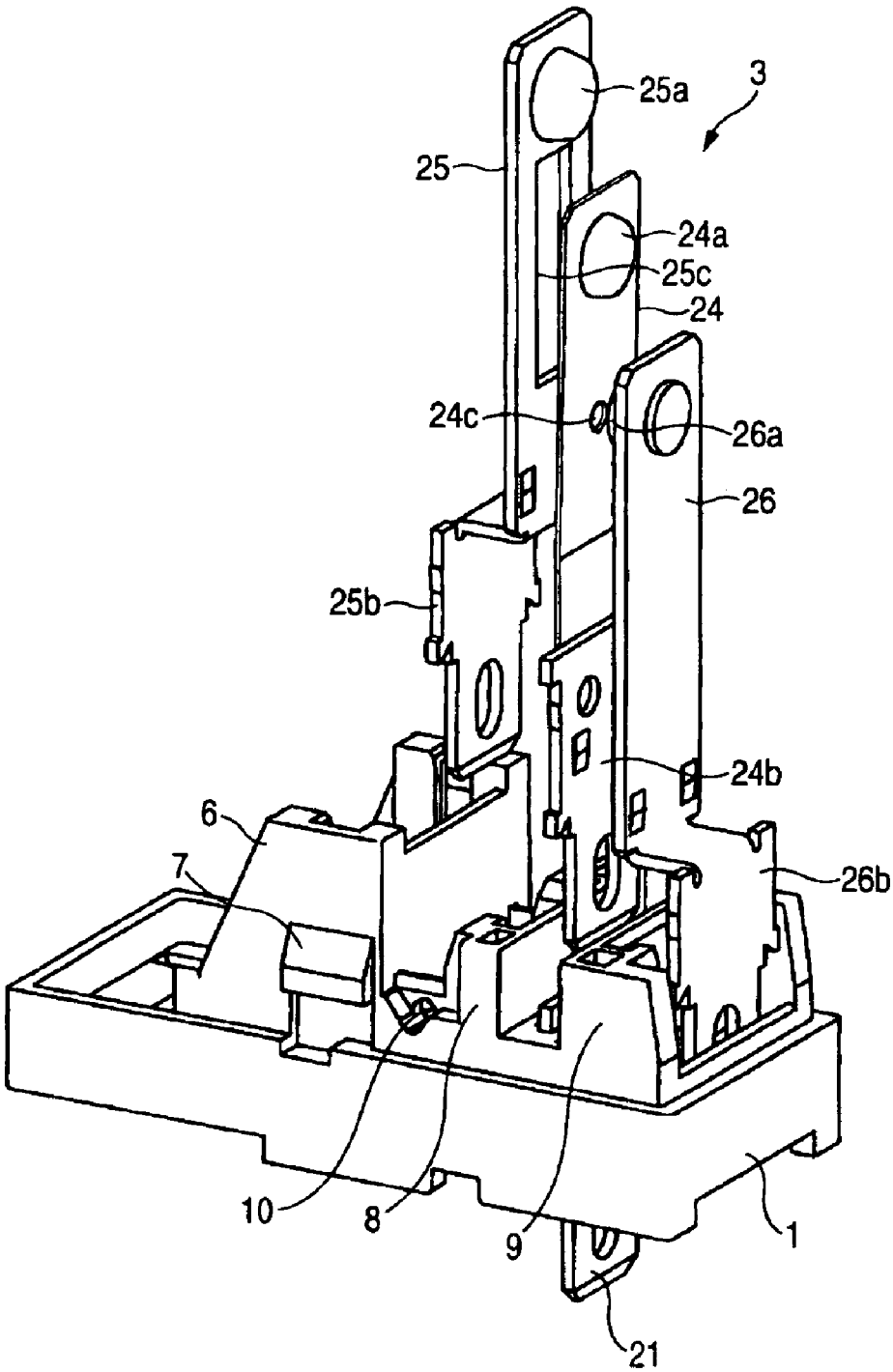
FIG. 5 is a disassembled perspective view of a base plate and a contact switching mechanism.
Figure 6:
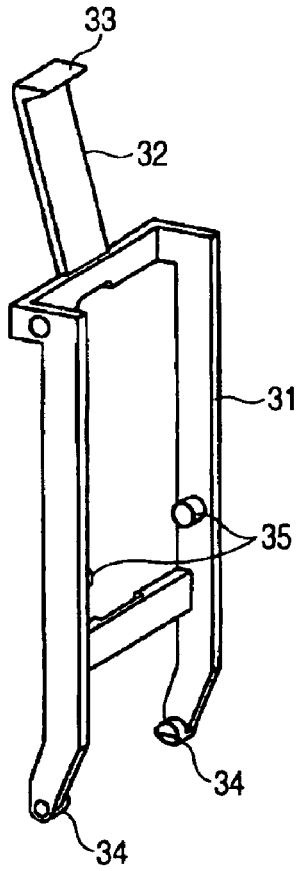
FIG. 6 is a perspective view of an indicator.

As shown in FIGS. 3 and 5, the base plate 1 is divided into a first area, in which the coil block 2 is arranged, and a second area, in which the contact switching mechanism 3 is arranged, by a first insulation wall 6. A locking projected portion 7 is formed in a side part of the first insulation wall 6. The locking projected portion 7 locks into a locking hole 36 of the case 4 to be described later, whereby the case 4 is attached to the base plate 1. In addition, the second area is divided into an area in which a first fixed contact piece 25 is fixed, an area in which a movable contact piece 24 is fixed, and an area in which a second fixed contact piece 26 is fixed, by a second insulation wall 8 and a third insulation wall 9. Bearing holes 10 are formed in side parts of the second insulation wall 8. An indicator 31 to be described later is rotatably supported by these bearing holes 10.

Figure 4:
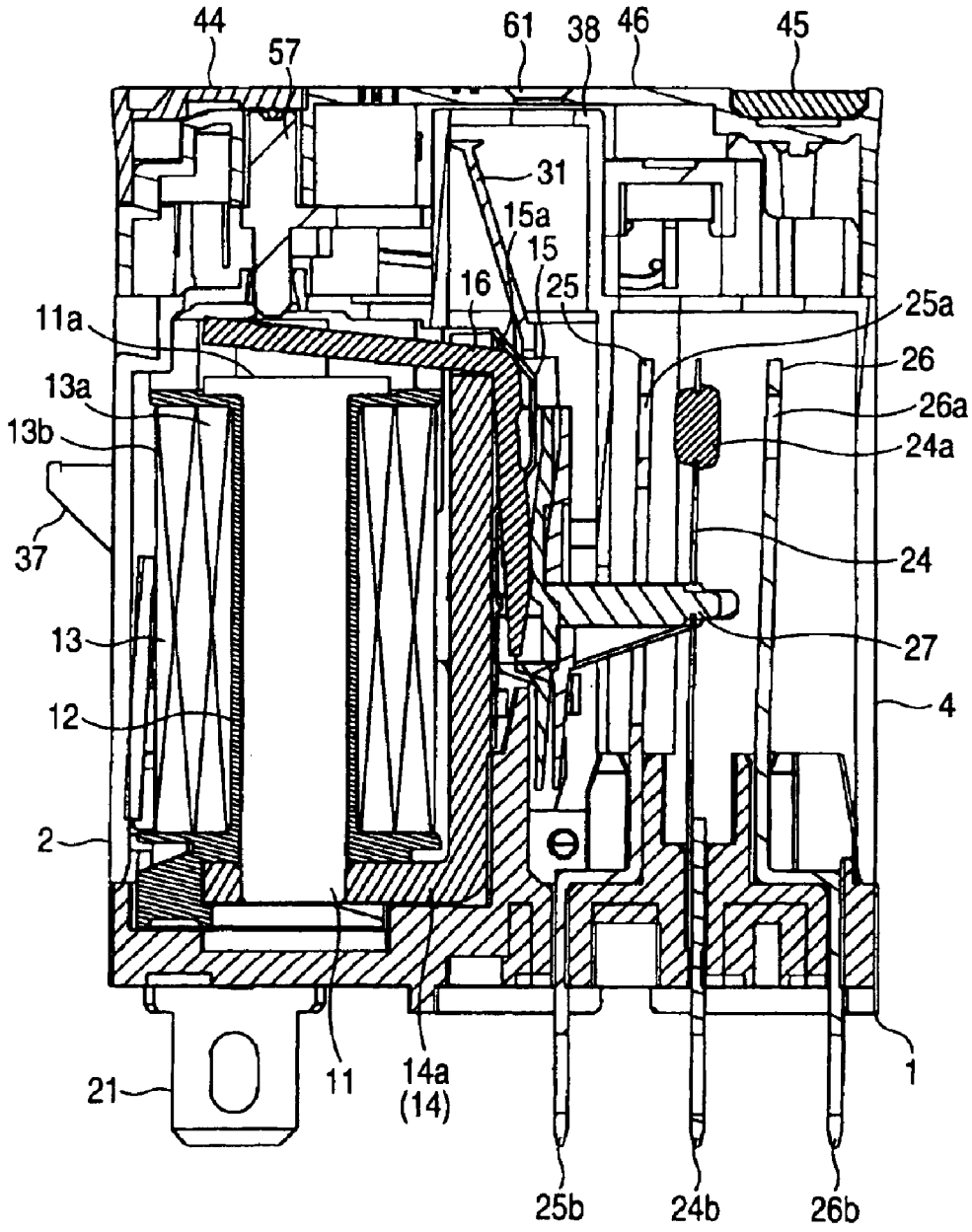
FIG. 4 is a sectional view of FIG. 1.
Figure 8:
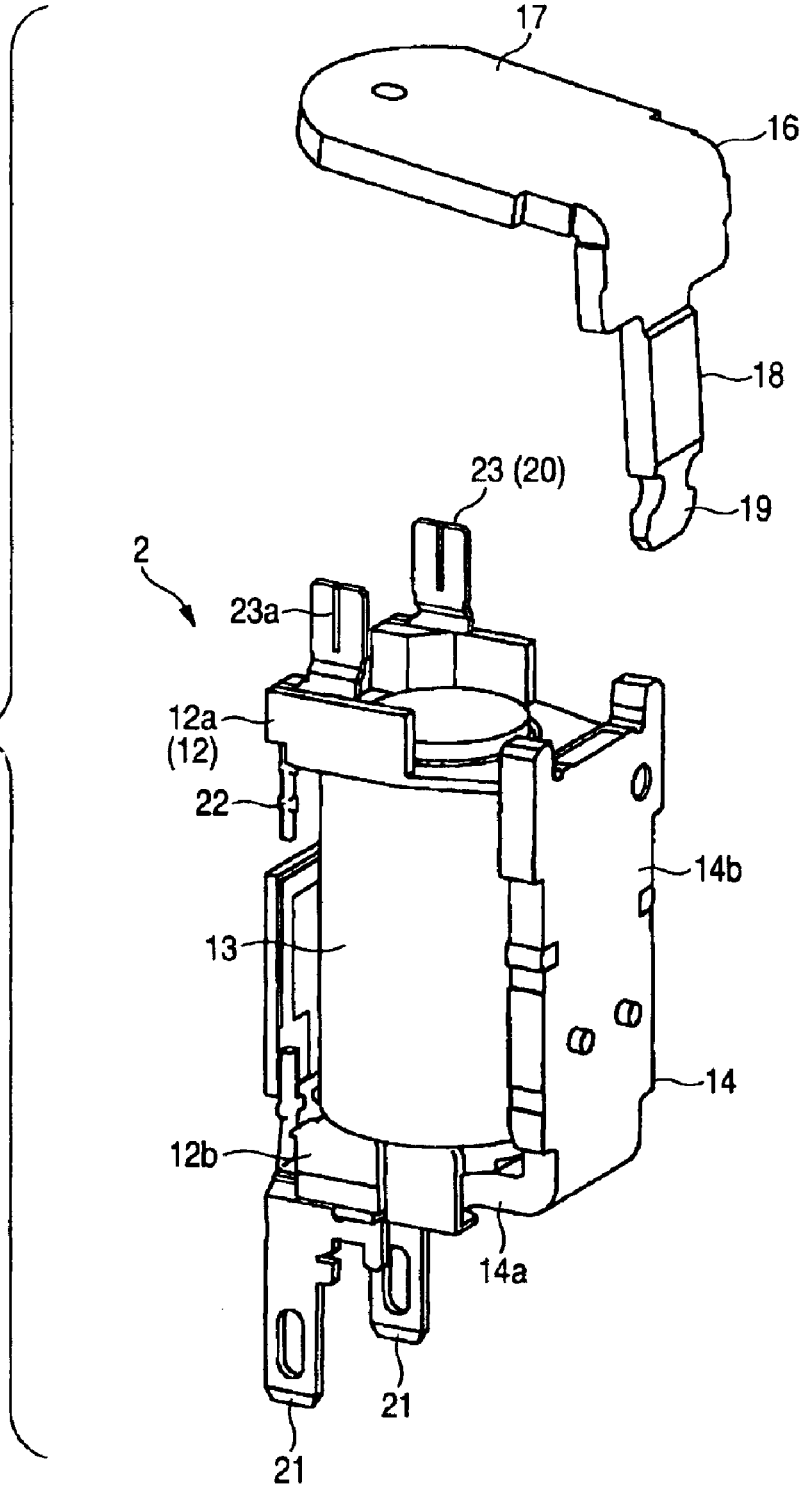
FIG. 8 is a perspective view of a coil block and a movable iron piece.

As shown in FIGS. 4 and 8, the coil block 2 is constituted by winding a coil 13 around an iron core 11 via a spool 12. A horizontal surface portion 14*a* of a yoke 14, which is bent in substantially an L shape, is calked at a lower end of the iron core 11. A vertical surface portion 14*b* of the yoke 14 extends upward along the wound coil 13, and a hinge spring 15 is fixed to a side of the yoke 14. A movable iron piece 16 is swingably supported at an upper end of the vertical surface portion 14*b* of the yoke 14.

As shown in FIG. 8, in the movable iron piece 16, a press receiving portion 18, which has a smaller width, is extended from an attracted portion 17, which is attracted by an attraction surface 11*a* of the iron core 11, via a bent part. A coupling portion 19 for coupling the movable iron piece 16 to a card 27 to be described later is formed at a tip of the press receiving portion 18. The movable iron piece 16 is pressed on the press receiving portion 18 by a pressing piece 15*a* of the hinge spring 15. If the coil block 2 is in a demagnetized state, the attracted portion 17 rotates so as to separate from the attraction surface 11*a* of the iron core 11.

As shown in FIG. 8, the spool 12 is fixed to an upper end collar portion 12*a* at first coil terminals 20 and to a lower end collar portion 12*b* at second coil terminals 21. In the first coil terminals 20, a coil 13 is wound around leg portions 22 at lower ends thereof, and lead wires 54 from an LED 50 to be described later are connected to electric connection portions 23 on upper end planes thereof. Projected rims 23*a* extending vertically are formed in central parts of the electric connection portions 23 such that electric connection with the lead wires 54 can be performed surely.

Figure 14A:
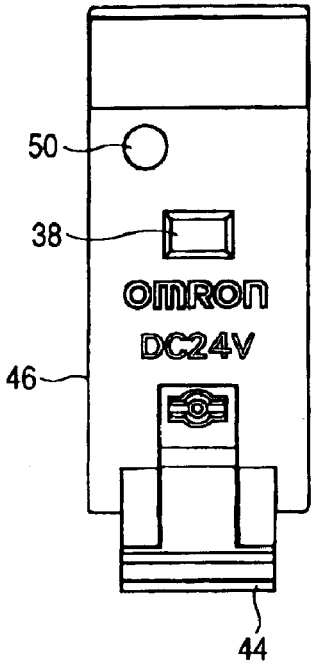
FIGS. 14A to 14C are views showing a state in which the operation lever is moved to a second opened position from a state of FIGS. 13A to 13C.
Figure 14B:
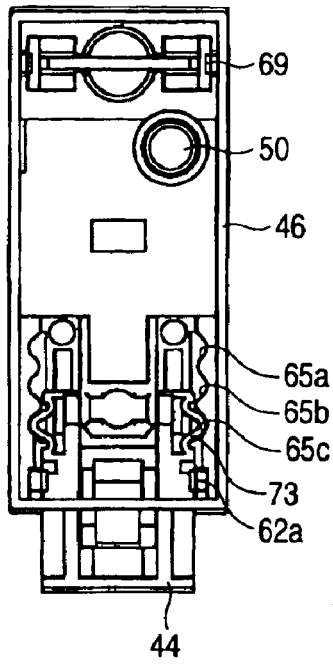
Figure 14C:
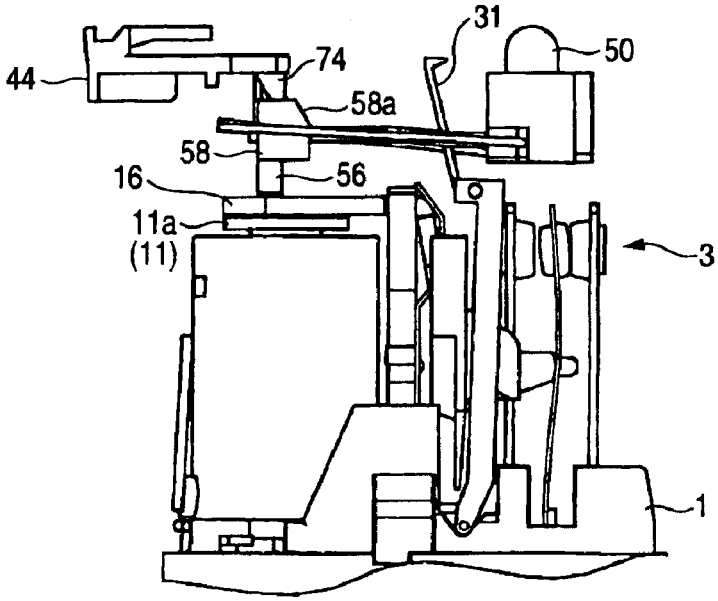

As shown in FIG. 14, the coil 13 is constituted by a first coil 13*a*, which is wound around a body of the spool 12 and connected to the first coil terminals 20, respectively, and a second coil 13*b*, which is wound around an outer periphery of the wound coil 13 and connected to the second coil terminals 21, respectively. Consequently, when a voltage is applied to the second coil terminals 21 to energize the second coil 13*b* on an outer peripheral side, an inductive electromotive force is generated in the first coil 13*a* on an inner peripheral side by an electromagnetic induction action. Thus, it is possible to cause a potential difference between the first coil terminals 20.

As shown in FIG. 5, the contact switching mechanism 3 is constituted by a movable contact piece 24, and a first fixed contact piece 25 and a second fixed contact piece 26 which are arranged on both sides of the contact piece 24. The movable contact piece 24 is tabular. At an upper end of the movable contact piece 24, movable contacts 24*a* exposed on both surfaces thereof are integrally formed. A lower end of the movable contact piece 24 constitutes a terminal portion 24*b*. In addition, a through-hole 24*c* is formed in the vicinity of a lower part of the movable contacts 24*a*. Both the first fixed contact piece 25 and the second fixed contact piece 26 are tabular. At upper ends of the first fixed contact piece 25 and the second fixed contact piece 26, a first fixed contact 25*a* and a second fixed contact 26*a*, which the movable contacts 24*a* come into contact with and separate from, are integrally formed. In addition, lower sides of both the fixed contact pieces 25 and 26 are bent in a crank shape and constitute terminal portions 25*b* and 26*b* which project from the lower surface of the base plate 1. In the first fixed contact piece 25, a slit 25*c* extending vertically from a lower part in the vicinity of the first fixed contact 25*a* is formed on an upper side thereof.

Figure 7:
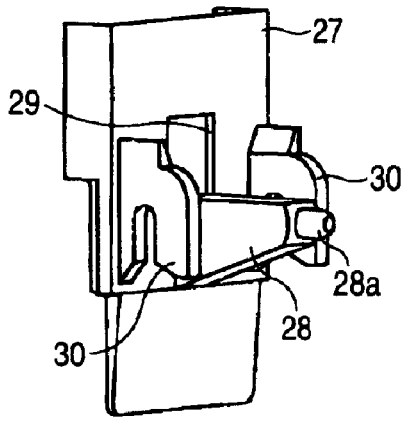
FIG. 7 is a perspective view of a card.

The movable contact piece 24 operates via the card 27 which is locked to one end of the movable iron piece 16. As shown in FIG. 7, the card 27 includes a pushing projected portion 28 in a central part of a tabular body. A projection 28*a* provided at a tip of the pushing projected portion 28 pierces through the through-hole 24*c* of the movable contact piece 24. A rectangular hole 29 is formed in the vicinity of an upper part of the pushing projected portion 28, and a coupling portion 19 of the movable iron piece 16 is coupled to the rectangular hole 29. Guide receiving portions 30 of substantially a U shape are formed on both sides of the card 27.

An operation of the movable contact piece 24 by the card 27 can be easily confirmed with the indicator 31. The indicator 31 is formed in substantially a frame body shape, and an indication piece 32 is formed in a center of an upper end connecting portion. A tip of the indication piece 32 is bent substantially at a right angle to constitute a visual recognition portion 33. Pivots 34 projecting in opposed directions are formed at lower ends on both sides of the indicator 31. The pivots 34 engage with the bearing holes 10 of the base plate 1, whereby the indicator 31 is attached to the base plate 1 so as to be rotatable. Both the sides of the indicator 31 are elastically deformable when the pivots 34 engage with the bearing holes 10. Consequently, the indicator 31 can be mounted to the base plat 1 easily. In addition, guide projected portions 35 projecting in opposed directions are formed in a center on both the sides of the indicator 31. The guide projected portions 35 are guided by the guide receiving portions 30 of the card 27, whereby the guide projected portions 35 and the guide receiving portions 30 are made movable integrally. A rotation center (pivots 34) of the indicator 31 is located on an opposite side of the indication piece 32 with respect to a pressing position of the card 27. Consequently, it is possible to amplify a quantity of movement of the indication piece 32 with respect to a quantity of movement of the card 27.

Figure 2:
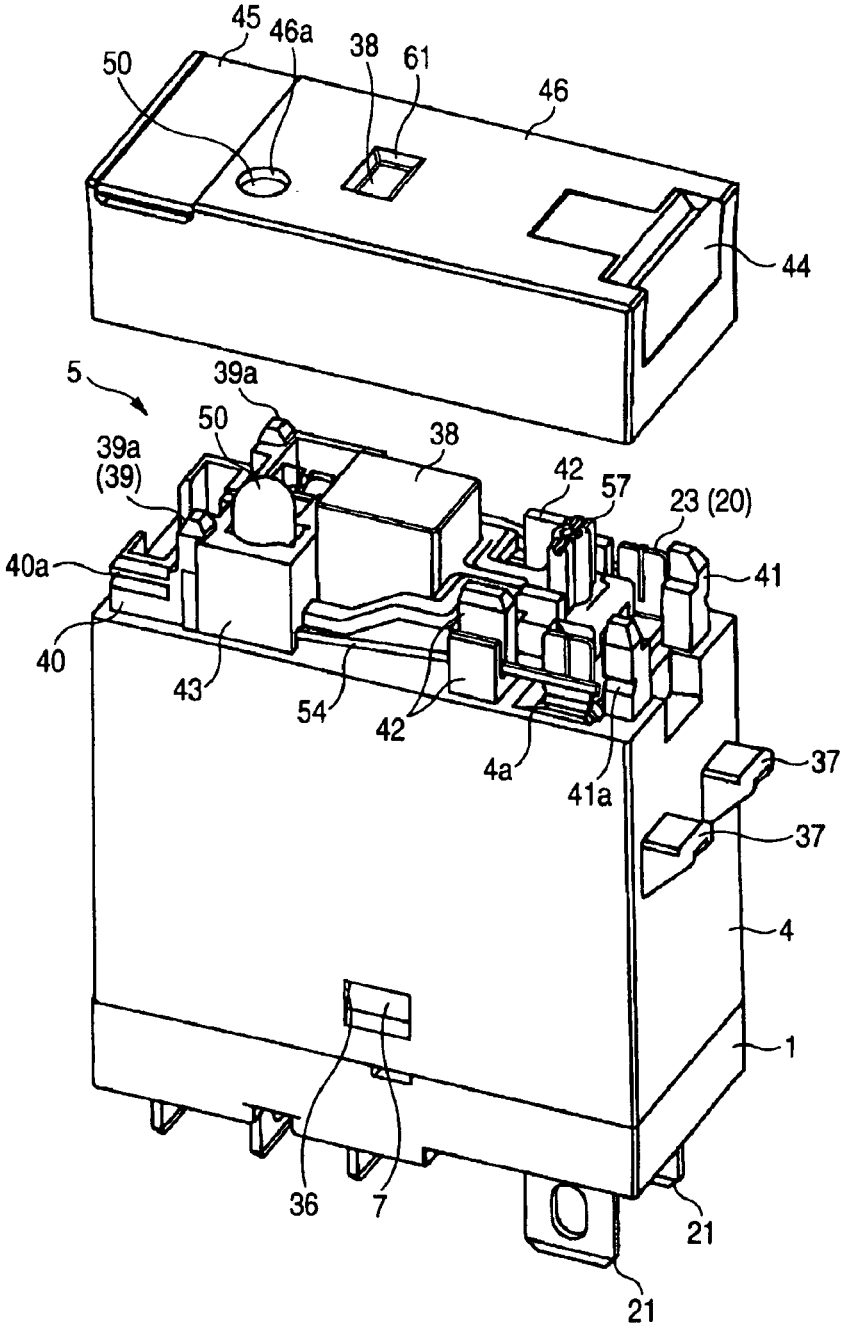
FIG. 2 is a perspective view showing a state in which a cover of FIG. 1 is removed.

As shown in FIG. 2, the case 4 has a box shape opening in a lower surface and is obtained by subjecting a resin material having translucency to fabrication. Locking holes 36, into which the locking projected portion 7 of the base plate 1 is locked and from which the locking projected portion 7 is unlocked, are formed in lower central parts on both sides of the case 4, respectively. In addition, pawl portions 37, on which a finger is put when the case 4 is removed after mounting the electromagnetic relay to a not-shown panel arranged in a vertical surface, is formed on one end face of the case 4. Further, an indication guide portion 38 is protrudingly provided in a central part on an upper surface of the case 4. A locking piece 39 and a reinforcement portion 40 are projected on one end side on the upper surface, and first guide pieces 41 and second guide pieces 42 are projected and slits 4*a* is formed on the other end side on the upper surface. The indication guide portion 38 is formed in a box shape and provides a space in which the indication piece 32 of the indicator 31 can operate. The locking piece 39 guides an LED holder 39 between the locking piece 39 and the indication guide portion 38 and prevents drop of an LED holder 43 from the case 4 with locking pawls 39*a* at an upper end thereof. The reinforcement portion 40 reinforces the locking piece 39 and includes locking grooves 40*a*, into which second locking pawls 69 of a cover 46 to be described later are locked and from which the second locking pawls 69 are unlocked. Locking grooves 41*a*, into which first locking pawls 62*a* (see FIG. 11) of the cover 46 are locked, are formed in central parts on side surfaces of the first guide pieces 41. In order to facilitate mounting of the cover 46, tips of the first guide pieces 41 are narrowed. The second guide pieces 42 include a pair of projected plates provided in parallel and guide lead wires 54 extending from the LED 50. The electric connection portions 23 of the first coil terminals 20 are inserted through the slits 4*a*.

As shown in FIG. 2, the indication block 5 has a structure in which the LED holder 43 is arranged on the upper surface of the case 4 and is covered with a cover 46 including an operation lever 44 and an indication panel 45.

Figure 9A:
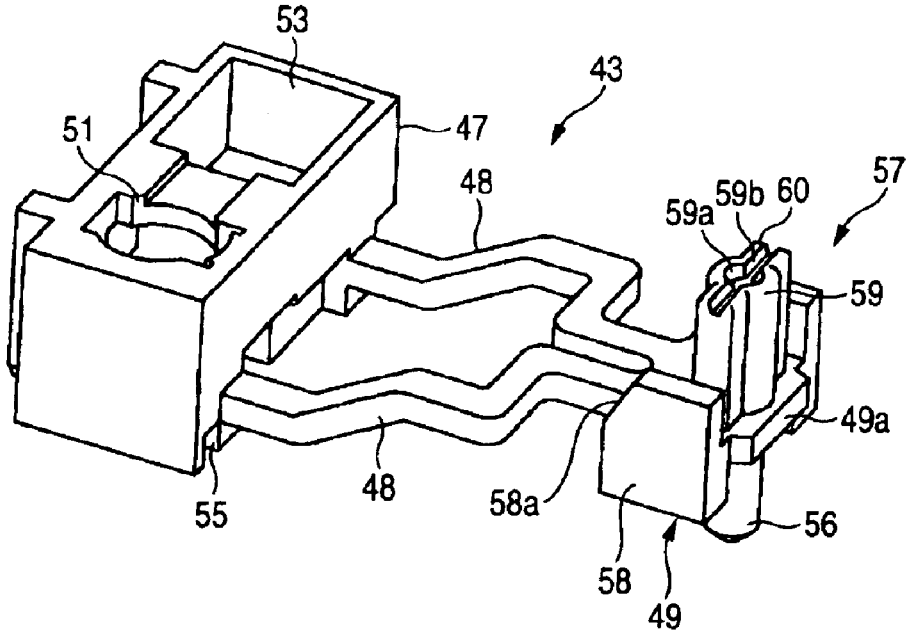
FIG. 9A is a perspective view of an LED holder.
Figure 9B:
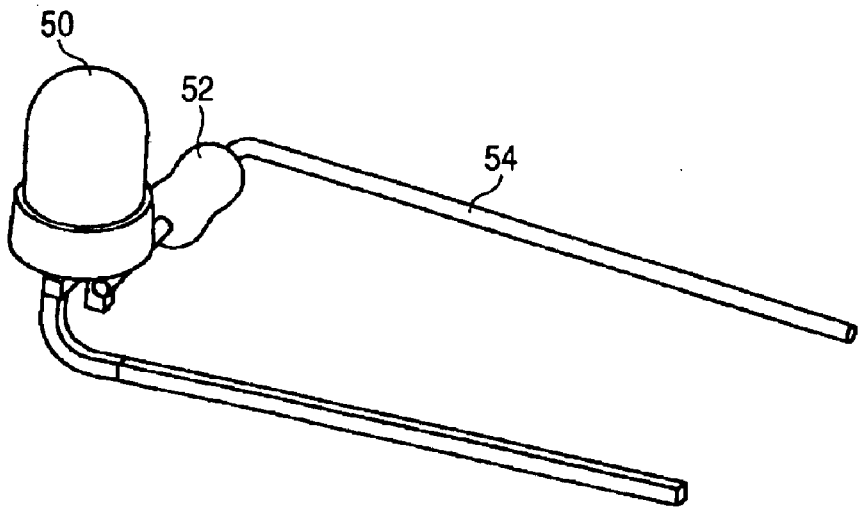
FIG. 9B is a perspective view of an LED.
Figure 10A:
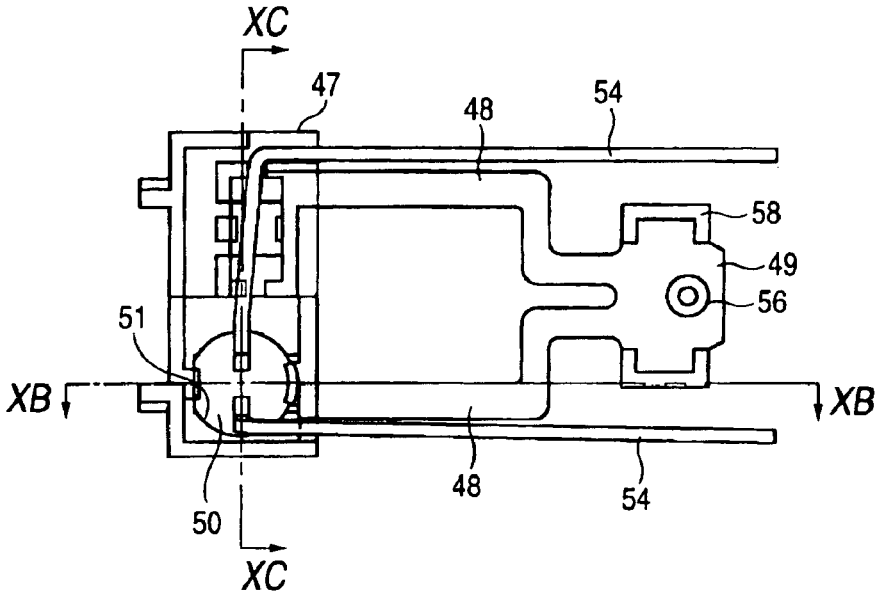
FIG. 10A is a bottom view of the LED holder.
Figure 10B:
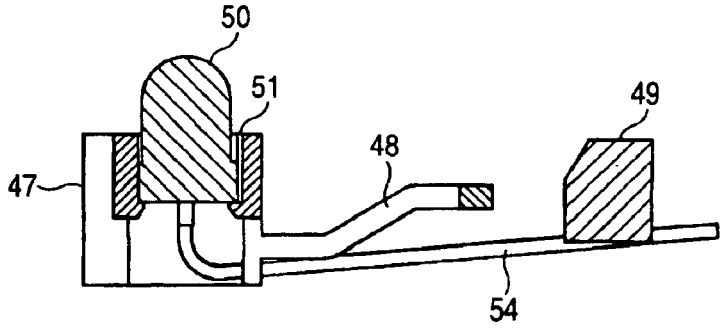
FIG. 10B is a sectional view along line XB—XB in FIG. 10A.
Figure 10C:
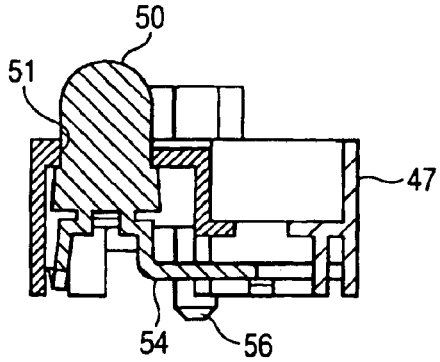

As shown in FIG. 9A, in the LED holder 43, elastic arm portions 48 are extended from a holder body 47, and activating portions 49 are formed at tips thereof.

In the holder body 47, a guide hole 51, which guides the LED 50, and a release hole 53 for avoiding interference with a resistor 52 connected to the LED 50 are formed. The lead wires 54 extending from the LED 50 are pulled out via cutoffs 55 which are formed at corners on a lower surface of the holder body 47.

The elastic arm portions 48 are extended in a side direction from both ends at side edges of the holder body 47 and are formed so as to be oriented obliquely upward, bent so as to approach each other, and continue to the activating portions 49. Consequently, it becomes easy to deform the elastic arm portions 48, and interference with the projected portions of the case 4 is avoided.

The activating portions 49 include a pressing portion 56, which projects downward from a central part on a lower surface of a support plate 40*a* continuing to the elastic arm portions 48, a first press receiving portion 57, which projects upward from a central part on an upper surface of the support plate 40*a*, and a second press receiving portion 58, which projects upward from both sides on an upper surface of the support plate 40*a*. The pressing portion 56 presses one end of the movable iron piece 16 to make the movable contact piece 24 operable via the card 27. The first press receiving portion 57 includes a cylindrical portion 59 in a center and extended portions 60 extending on both sides thereof. A recessed portion 59*a* is provided in a center of the cylindrical portion 59, and a groove portion 59*b* continuing to the extended portions 60 and the cylindrical portion 59 are formed. The recessed portion 59*a* prevents positional deviation at the time when the first press receiving portion 57 is pressed by a thing with a sharp point such as a pen. The groove portion 59*b* prevents positional deviation at the time when the first press receiving portion 57 is pressed by a tabular thing such as a driver. The second press receiving portion 58 is cut off at an upper corner on the holder body 47 side to form an inclined surface 58*a*. This inclined surface 58*a* is pressed by a pressing projected portion 74 of the operation lever 44, whereby it is possible to press the attracted portion 17 of the movable iron piece 16 with the pressing portion 56.

As described above, the LED holder 43 can not only hold the LED 50 but also make the movable iron piece 16 operable with the activating portions 49. Therefore, the electromagnetic relay has a fewer number of components and can be manufactured inexpensively. In addition, since the LED holder 43 can be assembled only by being mounted on the upper surface of the case 4, the electromagnetic relay is excellent in workability.

Figure 11:
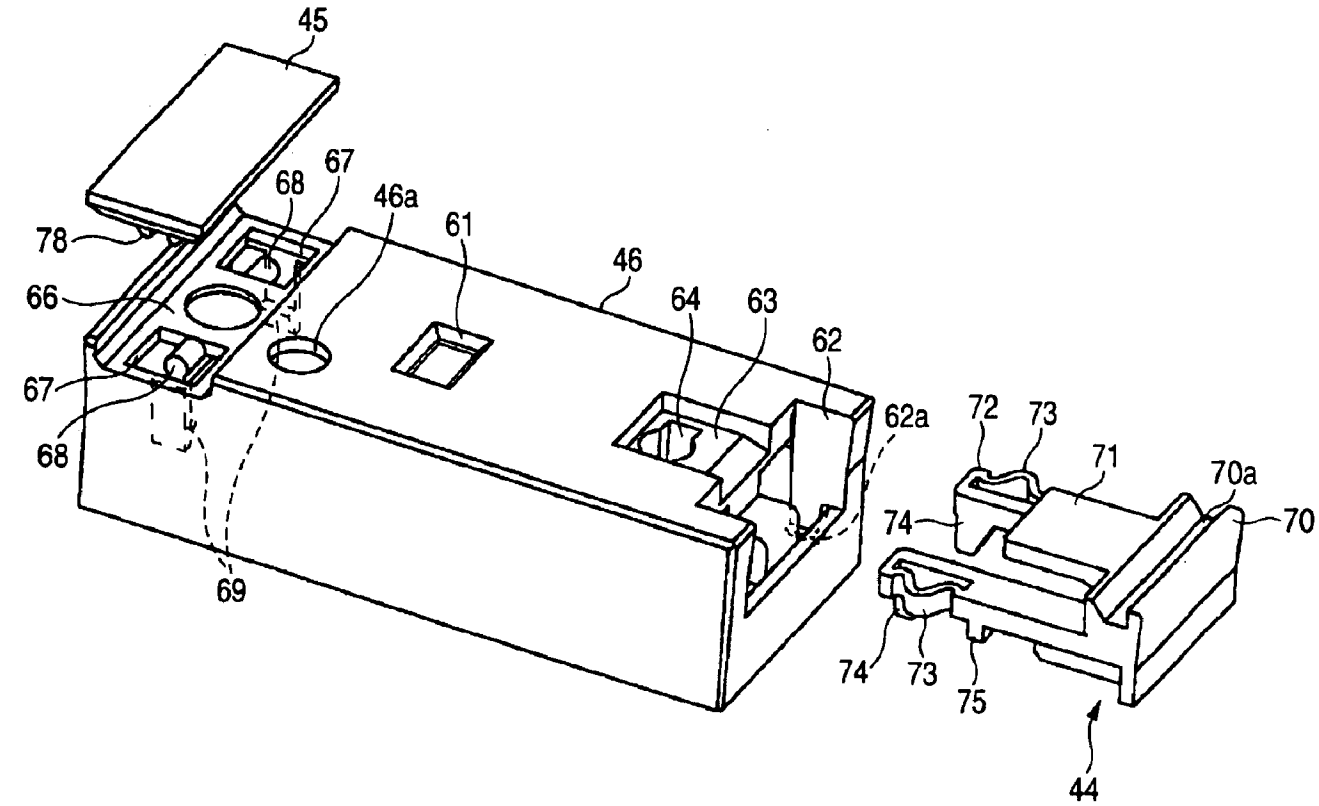
FIG. 11 is a disassembled perspective view of the cover.
Figure 12A:
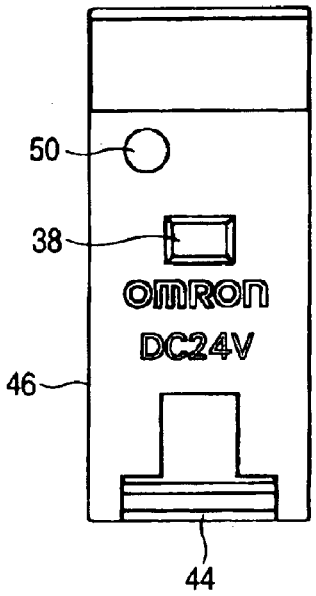
FIG. 12A is a plan view of the cover.
Figure 12B:
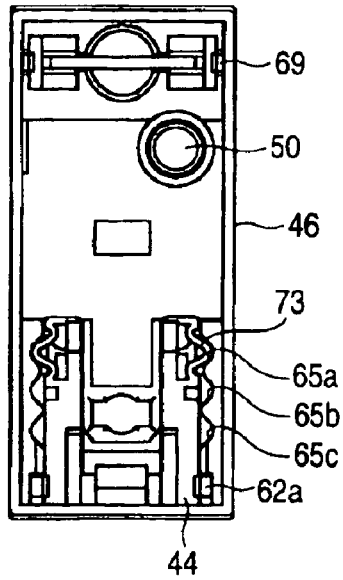
FIG. 12B is a bottom view of FIG. 12A.
Figure 12C:
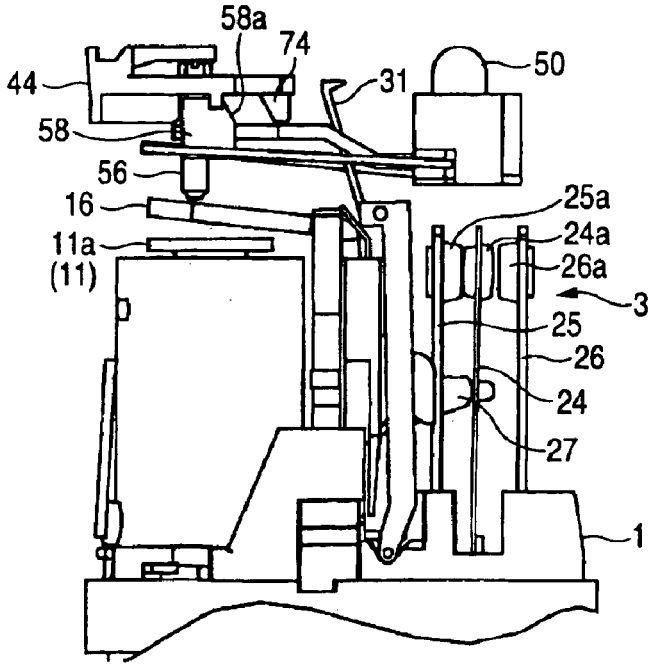
FIG. 12C is a partial front view showing an inner mechanism of the electromagnetic relay.

As shown in FIGS. 11 and 12, the cover 46 is formed in a box shape opening in a lower surface, and a window portion 61 is formed in a central part of an upper wall. The window portion 61 is adapted such that the indication piece 32 can be visually recognized when the indicator 31 is operated. At one end of the cover 46, an opening 62, in which the operation lever 44 is mounted, and a recessed portion 63, which continues from this opening 62 and is narrower than the opening 62, are formed. The opening portion 62 opens in the upper surface and a side of the cover 46. The recessed portion 63 is located on the upper surface of the cover 46. A through-hole 64, in which the first press receiving portion 57 of the LED holder 43 is located so as to be capable of being pressed in, is drilled in the central part of the recessed portion 63. On a lower surface of the upper wall (ceiling surface) of the cover 46, first, second, and third engagement receiving portions 65*a*, 65*b* and 65*c* are formed on both sides of the opening 62 by three hollow portions continuing in a corrugated shape. The first, second, and third engagement receiving portions 65*a*, 65*b* and 65*c* positions the operation lever 44 to be described later in a closed position, a first opened position, and a second opened position, respectively. A first locking pawl 62*a* is formed on an inner side of the opening 62. The locking grooves 41*a* of the first guide pieces 41, which project from the upper surface of the case 4, are locked with and unlocked from the first locking pawl 62*a*. In addition, a recessed portion for panel 66 for mounting the indication panel 45 is formed at the other end of the cover 46. In the recessed portion for panel 66, rectangular communicating holes 67 are formed on both sides thereof, and attachment portions 68 project therein. The attachment portions 68 are formed in a bar shape. In a sectional shape thereof, a trapezoidal portion, which gradually widens, is extended from a circular portion. The attachment portions 68 extend in a width direction on a rear surface of the recessed portion 63, and a free end is formed on one end side in the communicating holes 67. Further, the attachment portions 68 not only attach the indication panel 45 but also reinforce a part which is thinned by forming the recessed portion 63 and make flow of resin at the time of fabrication satisfactory. Second locking pawls 69, which extend in the vertical direction, are formed in the vicinity of the communicating holes 67 on the inner sides of the cover 46 and lock with and unlock from the locking grooves 40*a* formed in the reinforcement portion 40 of the case 24. According to the existence of the communicating holes 67, regardless of the structure in which the second locking pawls 69 are provided on the inner side, it is possible to subject the cover 46 to fabrication without requiring a slid mold. In addition, a through-hole 46*a* for exposing the LED 50 is formed in the vicinity of the window portion 61.

As shown in FIG. 11, the operation lever 44 includes an operation portion 70, a closing portion 71, and locking portions 72. The operation portion 70 closes the opening 62 of the cover 46 with an upper surface and sides thereof. A groove portion 70*a* extending in a width direction is formed on the upper surface of the operation portion 70. The groove portion 70*a* is used for hooking nails of fingers to slide the operation lever 44 with respect to the cover 46. The closing portion 71 extends in the horizontal direction from the operation portion 70 and is positioned in the recessed portion 63. Consequently, the first press receiving portion 57 located in the through-hole 64 is covered. The locking portions 72 extend from the operation portion 70 and are located below both sides of the closing portion 71. Elastic swelled portions 73 of an angle shape are provided on tip sides of the locking portions 72, and pressing projected portions 74 are formed on tip lower surfaces thereof. The elastic swelled portions 73 engage in and disengage from the first to the third engagement receiving portions 65*a* to 65*c* formed on the ceiling surface of the cover 46, respectively, and are positioned in the closed position (see FIG. 12), the first opened position (see FIG. 13), and the second opened position (see FIG. 14), respectively. As the operation lever 44 is slid, the pressing projected portions 74 press the second press receiving portion 58 of the LED holder 43. In addition, on lower surfaces of the locking portions 72, drop preventing projected portions 75, which abut against tips of the guide projected portions 35 projecting from the upper surface of the case 4 and prevent drop of the LED holder 43 from the cover 46, are formed.

Figure 15A:
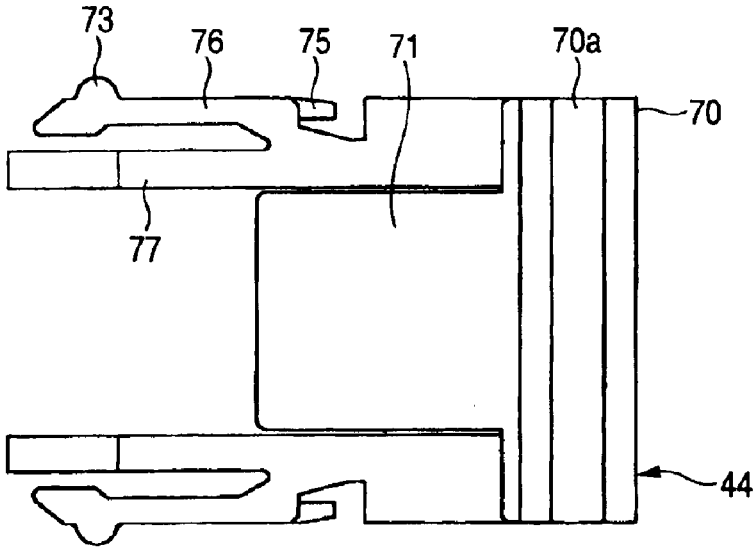
FIG. 15A is a front view showing an operation lever in accordance with another embodiment of the invention.
Figure 15B:
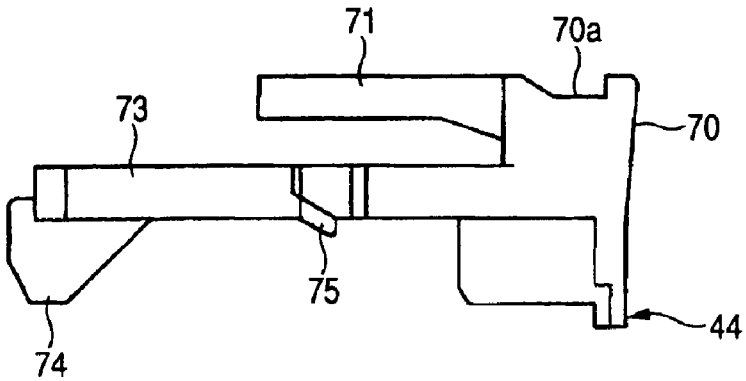
FIG. 15B is a front view showing the operation lever in accordance with another embodiment of the invention.

Note that, other than the above-mentioned structure, as shown in FIG. 15, the operation lever 44 may have a structure in which tips of the locking portions 72 are divided into a first elastic piece 76, in which the elastic swelled portion 73 is formed, and a second elastic piece 77, in which the pressing projected portion 74 is formed. According to this structure, engagement and disengagement with and from the engagement receiving portions 65 of the cover 46 by the elastic swelled portion 73 of the first elastic piece 76 and pressing of the second press receiving portion 58 of the LED holder 43 by the pressing projected portion 74 of the second elastic piece 77 can be performed independently. Consequently, it becomes possible to absorb fluctuation in an operation of the movable iron piece 16, that is, fluctuation in an amount of press-in by the LED holder 43 can be absorbed by an elastic force of the second elastic piece 77.

As shown in FIG. 11, the indication panel 45 is a panel on which a desired indication is applied by printing or adhesion of a label on a surface of a tabular body. Engagement pawls 78 in substantially a C shapes in section are formed at both ends on a rear surface thereof, respectively. The respective engagement pawls 78 engage with attachment portions 68 projecting in the communicating holes 67 of the cover 46 to fix the indication panel 45 to the recessed portion for panel 66. Since the engagement pawls 78 are provided in two portions at the both ends, an attachment state of the indication panel 45 can be stabilized without causing a warp or the like.

Next, an assembling method for the electromagnetic relay will be described.

The coil 13 is wound around the iron core 11 via the spool 12, and the yoke 14 is calked to the metal core 11, whereby the coil block 2 is formed in advance in a separate process. The ends of the coils 13*a* and 13*b*, which are wound around the inner and outer peripheries of the body of the spool 12, are wound around the respective coil terminals 20 and 21, which are insert-molded in the collar portions 12*a* and 12*b* of the spool 12, respectively.

First, the respective contact pieces 24*a*, 25*a* and 26*a* are pressed into the base plate 1 from above, and the terminal portions 24*b*, 25*b* and 26*b* are projected from the lower surface base plate 1. Then, the indicator 31 is attached such that the pivots 34 thereof are rotatably supported by the bearing holes 10. Subsequently, the card 27 is provisionally fixed by inserting the projection 28*a* at the tip thereof through the through-hole 24*c* of the movable contact piece 24 and locking the guide receiving portions 30 in the guide projected portions 35 of the indicator 31.

Subsequently, the coil block 2 is mounted to the base plate 1, and the terminal portions of the respective coil terminals 20 and 21 are projected from the lower surface of the base plate 1. Then, the movable iron piece 16 is arranged rotatably with the upper end of the vertical surface portion of the yoke 14 as a fulcrum and is biased by the pressing piece 15*a* of the hinge spring 15, and the coupling portion 19 is coupled to the rectangular hole 29 of the card 27. In this state, as a biasing force of the hinge spring 15 acts on the movable iron piece 16, the attracted portion 17 of the movable iron piece 16 separates from the attraction surface 11*a* of the iron core 11, and the movable contact piece 24 closes the movable contact 24*a* to the first fixed contact 25*a* with an elastic force of the movable contact piece 24.

If the assembly of the contact switching mechanism 3 and the coil block 2 to the base plate 1 is completed, the case 4 is covered over the base plate 1. At this point, the indication piece 32 of the indicator 31 is located in the indication guide portion 38 of the case 4, and the electric connection portions 23 of the first coil terminals 20 project upward via the slits 4*a* of the case 4.

Subsequently, the LED 50 is assembled to the LED holder 43 and mounted to the upper surface of the case 4. The LED holder 43 is inserted between the indication guide portion 38 and the locking piece 39 of the case 4 and fixed by the locking pawls 39*a*. The lead wires 54 extending from the LED 50 are welded to the electric connection portions 23 of the first coil terminals 20 projecting to the upper surface of the case 4. Since the projected rims 23*a* are formed in the electric connection portions 23, connection with the lead wires 54 can be performed surely.

Finally, the cover 46 is mounted to the upper surface of the case 4. The operation lever 44 and the indication panel 45 are attached to the cover 46 in advance. The operation lever 44 is slid from the one end side of the cover 46 into the opening 62 and attached. The indication panel 45 is positioned in the recessed portion 63 from above the cover 46 and attached by engaging the engagement pawls 78 in the attachment portions 68.

Subsequently, an operation of the electromagnetic relay will be described.

In a demagnetized state in which the coil 13 is not energized, the movable contact piece 24 comes into an upright state with an elastic force of the movable contact piece 24 itself and closes the movable contact 24*a* to the first fixed contact 25*a*. The movable iron piece 16 rotates such that the attracted portion 17 separates from the attraction surface 11*a* of the iron core 11 via the card 27 with the elastic force of the movable contact piece 24. Consequently, the indicator 31 rotates in the counterclockwise direction in FIG. 4 around the pivots 34 together with the card 27. Therefore, the indication piece 32 cannot be visually recognized from the window portion 61 of the cover 46.

Then, when the coil 13 is energized and excited, the attracted portion 17 of the movable iron piece 16 is attracted to the attraction surface 11*a* of the iron core 11, and the movable iron piece 16 rotates in the clockwise direction in FIG. 4. Consequently, the movable contact piece 24 is driven via the card 27, and the movable contacts 24*a* separates from the first fixed contact 25*a* and closes to the second fixed contact 26*a*. In addition, following the movement of the card 27, the indicator 31 rotates in the clockwise direction in FIG. 4 around the pivots 34. Consequently, the indication piece 32 is located in the window portion 61 of the cover 46 and can be visually recognized from the outside. Therefore, an operation state of the contact switching mechanism 3 can be grasped at a glance. In addition, the LED 50 is lit by energization of the coil 13, and an excitation state of the coil block 2 can be grasped at a glance.

Figure 13A:
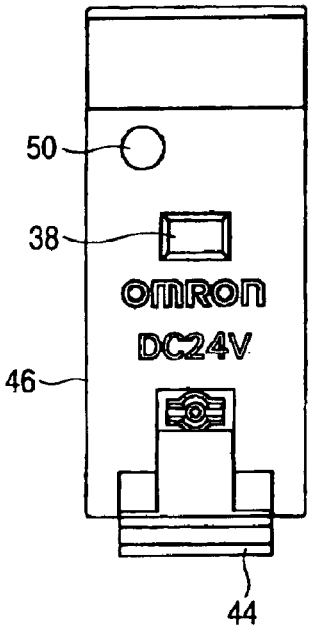
FIGS. 13A to 13C are views showing a state in which an operation lever is moved to a first opened position from the state of FIGS. 12A to 12C.
Figure 13B:
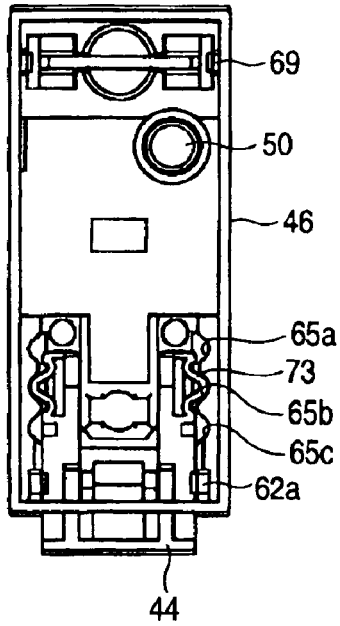
Figure 13C:
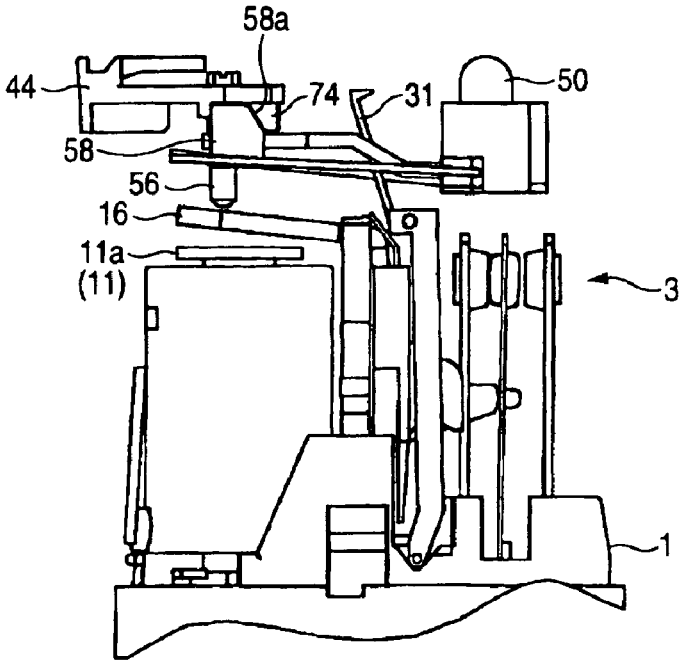

In addition, when the operation lever 44 is slid to the first opened position in the demagnetized state in which the coil 13 is not energized, as shown in FIG. 13A, the first press receiving portion 57 of the LED holder 43 is exposed. Consequently, it becomes possible to press in the first press receiving portion 57. When the first press receiving portion 57 is pressed in, the elastic arm portions 48 elastically deform, and the pressing portion 56 moves downward. Consequently, the movable iron piece 16 rotates, and the movable contact piece 24 operates via the card 27. At this point, the indicator 31 rotates following the movement of the card 27, and the indication piece 32 can be visually recognized from the window portion 61. In other words, an operation state of the movable iron piece 16 is confirmed.

In addition, when the operation lever 44 is further slid from the first opened position to the second opened position, as shown in FIG. 14, the pressing projected portions 74 of the operation lever 44 presses the second press receiving portion 58 of the LED holder 43, and the elastic arm portions 48 elastically deform. Consequently, the pressing projected portions 74 pushes up the activating portions 49 of the LED holder 43, the movable iron piece 16 is maintained in the pressed state by the pressing portion 56, and the movable contact 24*a* closes to the second fixed contact 26*a*. At this point, it becomes possible to visually recognize the indication piece 32 of the indicator 31 from the window portion 61 of the cover 46. In other words, an operation state of the movable iron piece 16 can be confirmed.

Note that, in the above-mentioned embodiment, the movable contact 24*a* in one portion is brought into contact with and separated from the fixed contacts 25*a* and 26*a* in two portions. However, movable contacts in two portions may be brought into contact with and separated from fixed contacts in two portions, respectively.

Figure 16:
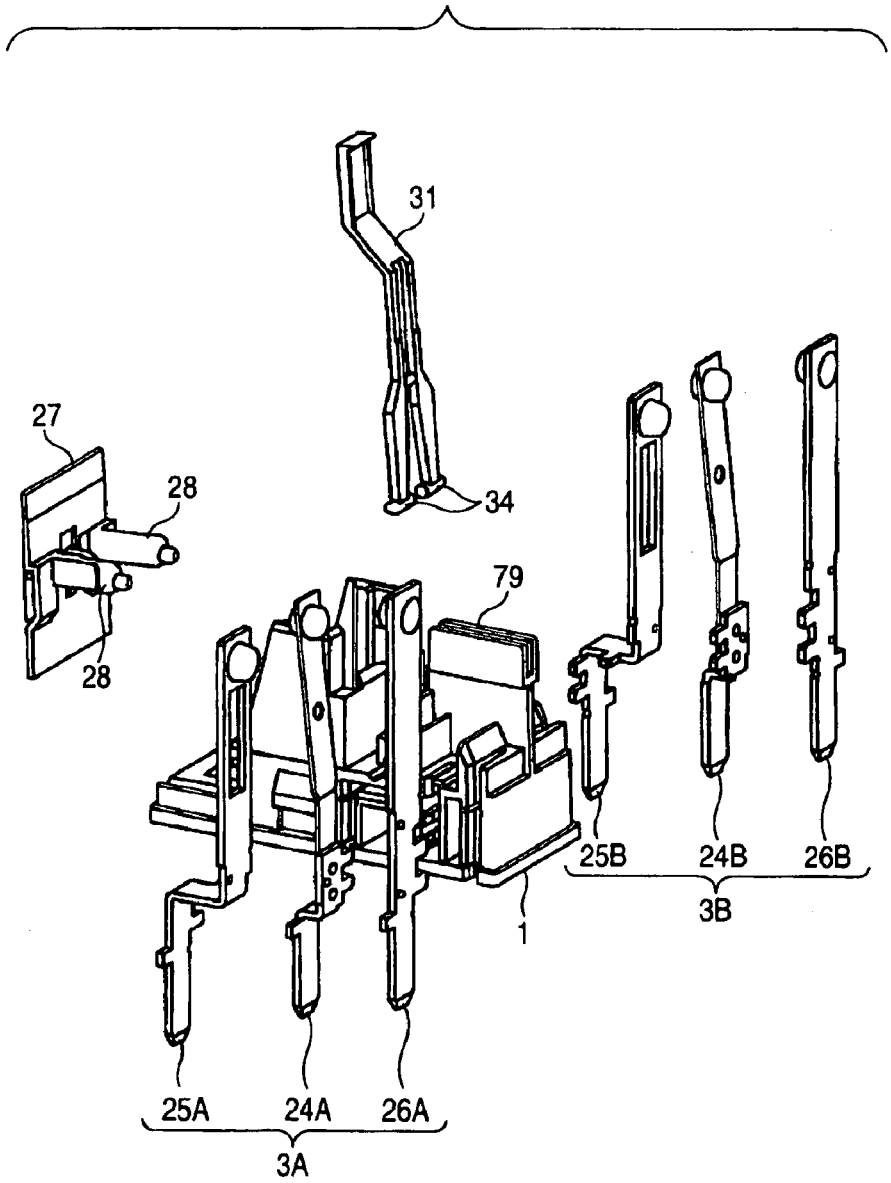
FIG. 16 is a disassembled perspective view showing a base block and a contact switching mechanism in accordance with another embodiment of the invention.

In this case, as shown in FIG. 16, the base plate 1 is constituted such that the respective contact switching mechanisms 3 including the movable contact pieces 24A and 24B and the pairs of fixed contact pieces 25A and 25B, 26A and 26B can be pressed in from both the sides, respectively. Further, the second area is divided into two in the width direction by a fourth partition wall 79 to realize insulation between the respective contact switching mechanisms 3. In addition, the indicator 31 is divided into two in a lower half part thereof to form the pivots 34 projecting in opposed directions at the lower end thereof. The pivots 34 are rotatably supported by not-shown bearing holes formed in the fourth partition wall 79. In addition, the card 27 includes the pushing projected portions 28 in two portions on both sides thereof and presses the respective movable contact pieces 24. Note that other parts of the structure are substantially the same as the above-mentioned embodiment, and descriptions of the parts will be omitted.

In addition, although the card 27 and the indicator 31 are constituted as separate bodies in the above-mentioned embodiment, the card 27 and the indicator 31 may be constituted integrally.

Figure 17B:
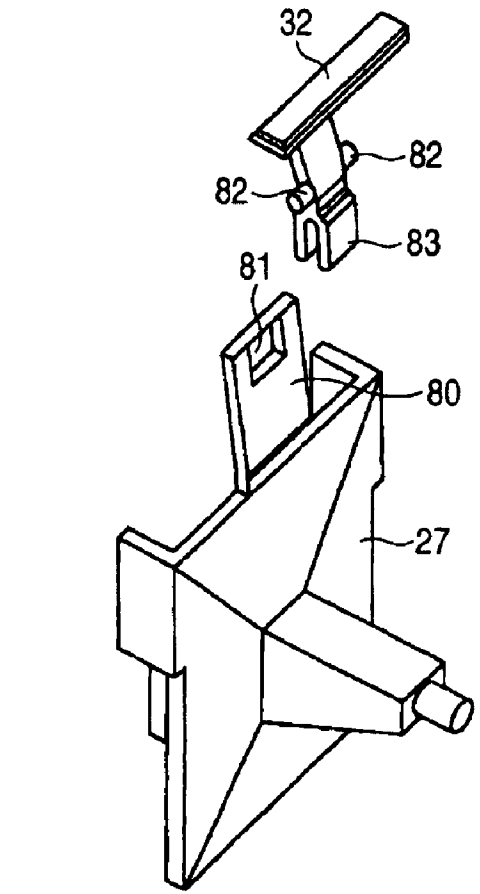
FIGS. 17A and 17B are perspective views showing a card in accordance with another embodiment.
Figure 17A:
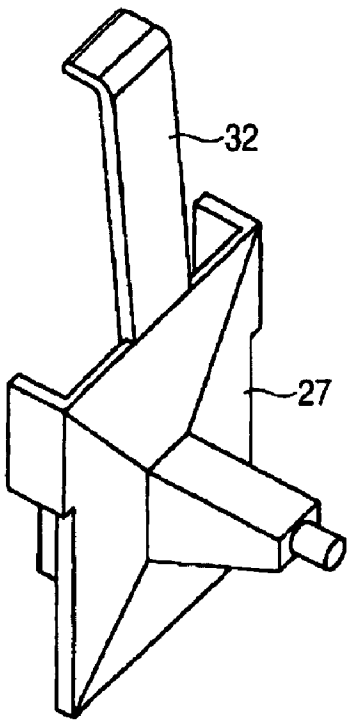

In FIG. 17A, the indication piece 32 is integrally formed in a central part at an upper edge of the card 27.

In FIG. 17B, an extended portion 80 is formed in the central part at the upper edge of the card 27, and the indication piece 32 is connected to this extended portion. In other words, an indication piece 32 is attached to the case so as to be rotatable around pivots 82, and a locking piece 83 of the indication piece 32 is rotatably connected to a locking receiving hole 81 drilled in the extended portion 80. Consequently, it becomes possible to increase a rotation range of the indication piece 32 compared with the case in which an indication piece is directly extended from the card 27. Therefore, even with an electromagnetic relay which is small and has a less quantity of movement of the card 27, since an operation of the indication piece 32 can be amplified, confirmation of an operation can be performed surely. In addition, since the indication piece 32 is rotatably provided in the case 4, an occupied space can be reduced, and it becomes possible to realize miniaturization of an electromagnetic relay.

Figure 18:
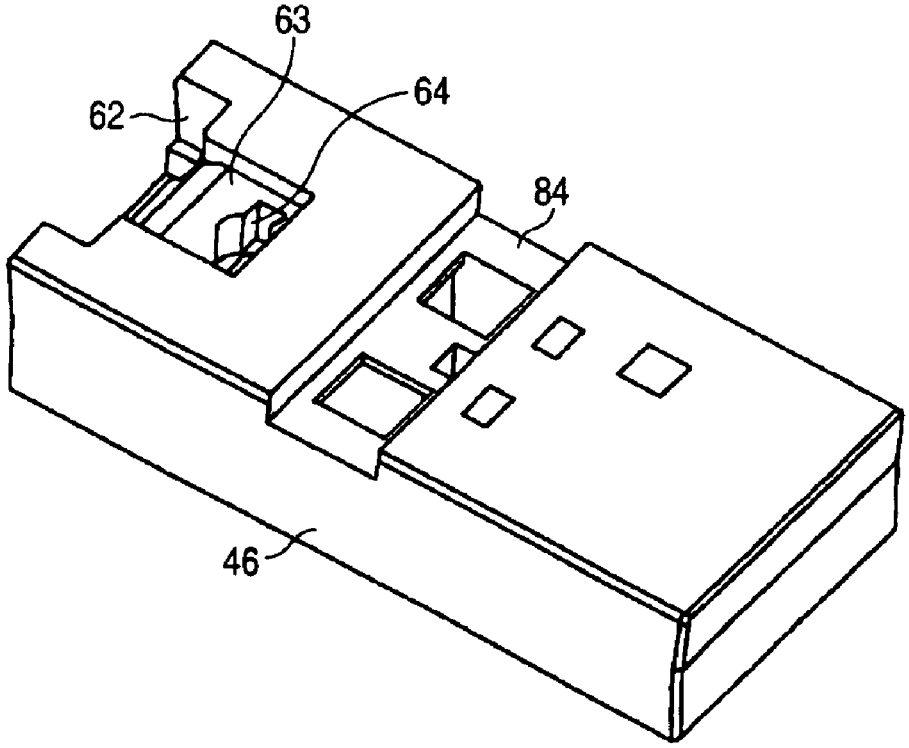
FIG. 18 is a perspective view of a cover in accordance with another embodiment of the invention.

In this case, it is possible to change the cover 46, for example, as shown in FIG. 18. In other words, the recessed portion for panel 66 may be formed in the central part of the cover 46 to make it possible to attach the indication panel 45 in the recessed portion for panel 66 in the central part.

As it is evident from the above description, according to the invention, the electromagnetic relay is constituted with the elastically deformable structure including the pivots rotatably supported by the bearing portions of the base plate. Thus, assemblability is improved, the indicator can be operated smoothly, and it becomes possible to reduce power consumption of the coil block.

What is claimed is:

1. An electromagnetic relay which provides a coil block and a contact switching mechanism on a base plate to cover the base plate with a case and is adapted to excite and demagnetize the coil block to rotate a movable iron piece, and operate a movable contact piece via a card to thereby open and close a contact, wherein a bearing portion is formed on the base plate, an indicator to be operated by rotation of the movable iron piece is provided, and the indicator has an elastically deformable structure including a rotatably supported pivot in the bearing portion of the base plate.

2. An electromagnetic relay according to claim 1, wherein the indicator comprises a guide portion, which guides the indicator such that upward movement of the indicator is prevented by a guide receiving portion formed in the card.

3. An electromagnetic relay according to claim 2, wherein the guide portion is constituted by a shaft portion and the guide receiving portion is formed in substantially a U shape for guiding the shaft portion from an upper part.

4. An electromagnetic relay according to claim 1, wherein the indicator has an indication piece at an upper end thereof and comprises a guide portion between the indication piece and the pivot.

5. An electromagnetic relay according to claim 4, wherein the case comprises a projected portion, which forms a space in which the indication piece of the indicator can operate.

6. An electromagnetic relay according to claim 4, wherein a cover is mounted on an upper surface of the case and a window, which makes the indication piece visible only when the coil block is excited and the indicator operates.

7. An electromagnetic relay according to claim 2, wherein the indicator has an indication piece at an upper end thereof and comprises the guide portion between the indication piece and the pivot.

8. An electromagnetic relay according to claim 3, wherein the indicator has an indication piece at an upper end thereof and comprises the guide portion between the indication piece and the pivot.

9. An electromagnetic relay according to claim 7, wherein the case comprises a projected piece, which forms a space in which the indication piece of the indicator can operate.

10. An electromagnetic relay according to claim 8, wherein the case comprises a projected piece, which forms a space in which the indication piece of the indicator can operate.

11. An electromagnetic relay according to claim 7, wherein a cover is mounted on an upper surface of the case and a window, which makes the indication piece visible only when the coil block is excited and the indicator operates.

12. An electromagnetic relay according to claim 8, wherein a cover is mounted on an upper surface of the case and a window, which makes the indication piece visible only when the coil block is excited and the indicator operates.

13. An electromagnetic relay according to claim 9, wherein a cover is mounted on an upper surface of the case and a window, which makes the indication piece visible only when the coil block is excited and the indicator operates.

14. An electromagnetic relay according to claim 10, wherein a cover is mounted on an upper surface of the case and a window, which makes the indication piece visible only when the coil block is excited and the indicator operates.

* * * * *